US005957380A

United States Patent [19]

Fitterman et al.

[11] Patent Number: 5,957,380

[45] Date of Patent: Sep. 28, 1999

[54] DISPOSABLE CIGAR HUMIDIFICATION APPARATUS

[76] Inventors: Milton Fitterman, 7 Saddle Ridge Rd., Hohokus, N.J. 07423; Michael Catalano, 196 Summit Ave., Bogota, N.J. 07603

[21] Appl. No.: 08/980,752

[22] Filed: Dec. 1, 1997

[51] Int. Cl.[6] ..... A24F 25/02; C09K 3/00

[52] U.S. Cl. ..... 239/55; 239/53; 239/54; 239/56; 252/194; 261/DIG. 41

[58] Field of Search ..... 252/194; 239/53, 239/54, 55, 56; 261/DIG. 41

[56] References Cited

U.S. PATENT DOCUMENTS

| | | | |
|---|---|---|---|
| 1,407,274 | 2/1922 | Hibbert | 252/194 |
| 1,474,254 | 11/1923 | Gerstle | 239/55 |
| 1,481,325 | 1/1924 | Le Gris | 239/55 |
| 1,588,595 | 6/1926 | Le Gris | 239/55 |
| 1,742,962 | 1/1930 | McCrosky | 239/55 |
| 1,880,275 | 10/1932 | Phillips | 252/194 |
| 3,652,423 | 3/1972 | Roberts | 252/180 |
| 4,028,239 | 6/1977 | Zinsstag et al. | 210/58 |
| 4,428,892 | 1/1984 | Berliner | 261/99 |
| 5,011,009 | 4/1991 | Scheurer | 206/270 |
| 5,037,698 | 8/1991 | Brunel | 252/194 X |
| 5,556,579 | 9/1996 | Newman | 261/99 |
| 5,607,051 | 3/1997 | Espinosa | 206/213.1 |

FOREIGN PATENT DOCUMENTS

| | | | |
|---|---|---|---|
| 468331 | 9/1950 | Canada | 239/55 |
| 6-165906 | 6/1994 | Japan | 252/194 |
| 1669514 | 8/1991 | U.S.S.R. | 252/194 |

*Primary Examiner*—Richard D. Lovering
*Attorney, Agent, or Firm*—St. Onge Steward Johnston & Reens LLC

[57] ABSTRACT

A cigar humidification apparatus comprises a sealed hollow cylindrical container having at least one, and preferably two removable end caps; a porous material contained in the sealed container; and a humidification solution provided in the porous material. The porous material is preferably florists foam. The humidification solution consists of 1–10% propylene glycol; 10–24% water; and 70–80% saturated salt solution. The salt solution is preferably a saturated solution of sodium chloride in water.

16 Claims, 1 Drawing Sheet

10
12
14
16
18
20
22
24

DISPOSABLE CIGAR HUMIDIFICATION APPARATUS

FIELD OF THE INVENTION

The present invention relates to the field of cigar humidors and humidification agents for maintaining humidity of cigars in a sealed container.

BACKGROUND OF THE INVENTION

Cigars are kept freshest when stored at the correct combination of temperature and humidity. Too little humidity leads to a dry cigar which will burn too hot and harsh, while too much humidity can prevent correct burning and draw, and may also lead to spoliation and mold.

A relative humidity of 70% to about 72% at 70° F. is generally regarded as an optimal humidity level for storage of cigars. A common humidification solution used in cigar humidors is a 50%/50% water/propylene glycol solution. However, such solutions are usually used in reservoirs in expensive humidors and can be expensive.

It would be desirable to provide a disposable cigar humidification apparatus and solution usable for inexpensive humidification of cigars in the correct relative humidity range.

SUMMARY OF THE INVENTION

It is an object of the invention to provide a cigar humidification apparatus and solution which is inexpensive to manufacture and use, and which is disposable, and which can be used with smaller travel humidors (including plastic containers with lids (such as Tupperware® containers) and sealable plastic bags (such as ZipLoc® bags) that do not have the space for a large capacity humidification system. "Tupperware" is a trademark of Dart Industries, Inc.; ZipLoc is a trademark of DowBrands, Inc.

These objects, and other objects as disclosed in this application, are achieved as described below.

A cigar humidification apparatus in accordance with one embodiment of the invention comprises a sealed hollow cylindrical container having at least one, and preferably two removable end caps; a porous material contained in the sealed container; and a humidification solution provided in the porous material. The porous material is preferably florists foam. The humidification solution consists of 1–10% propylene glycol; 10–24% water; and 70–80% saturated salt solution. The salt solution is preferably a saturated solution of sodium chloride in water.

Other objects, aspects and features of the present invention in addition to those mentioned above will be pointed out in detail or will be understood from the following detailed description provided in conjunction with the accompanying drawings.

BRIEF DESCRIPTION OF THE DRAWINGS

The foregoing aspects and other features of the invention are explained in the following description, taken in connection with the accompanying drawings, wherein.

DETAILED DESCRIPTION OF THE INVENTION

Figures 1, 2, 3, 4:
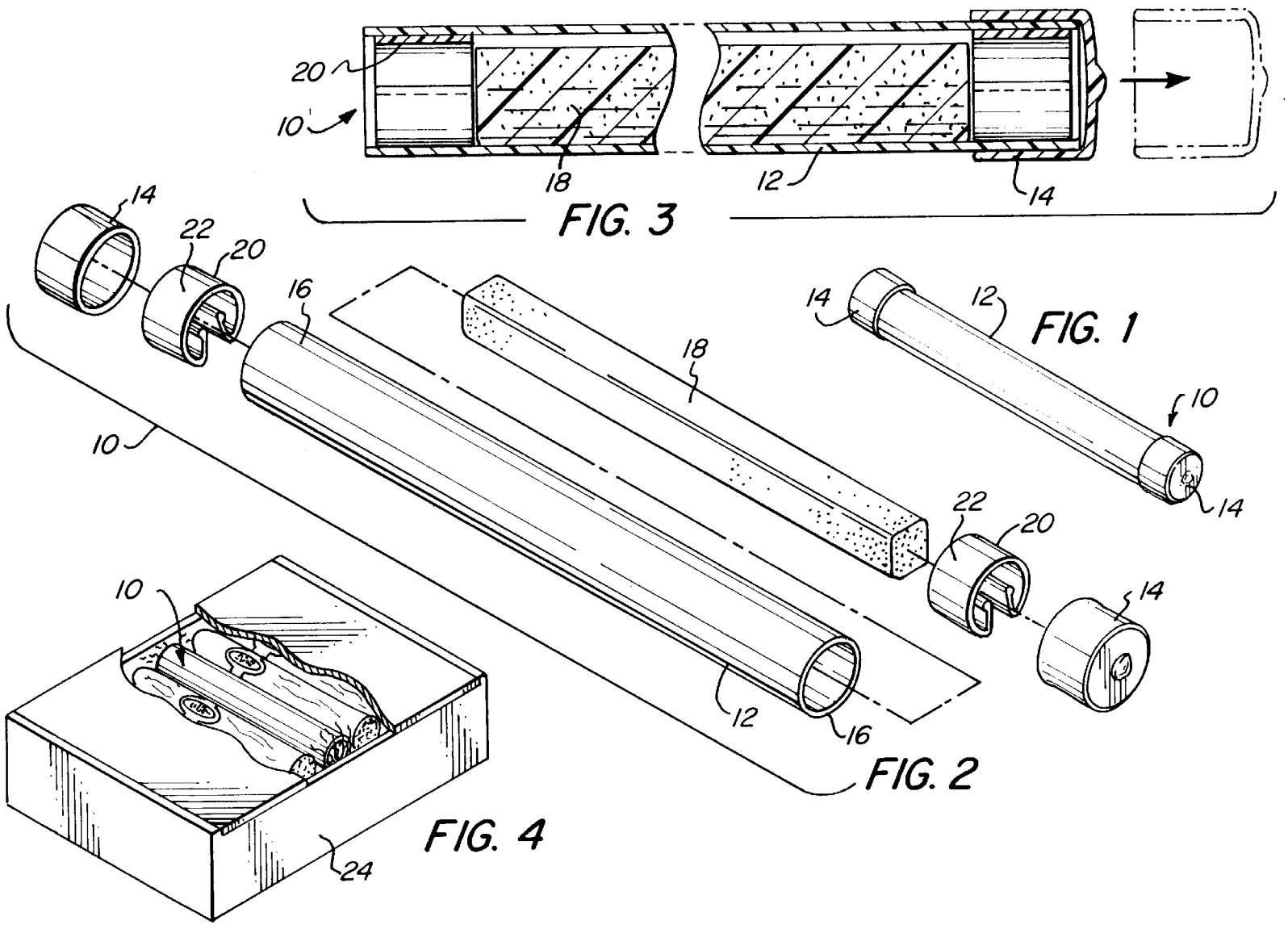
FIG. 1 is a perspective view of an embodiment of a cigar humidification apparatus in accordance with the invention.
FIG. 2 is an exploded perspective view of the cigar humidification apparatus of FIG. 1.
FIG. 3 is a side elevation cross-sectional view of the cigar humidification apparatus of FIG. 1, with an end cap shown on one end, and removed from the other end.
FIG. 4 is a perspective view of a cigar humidification apparatus in accordance with the invention in use.

Referring now to FIGS. 1–4 where like numbers identify the same elements in the drawings, a cigar humidification apparatus 10 is shown. Cigar humidification apparatus 10 comprises a hollow cylindrical container such as tube 12. Tube 12 is preferably a thin walled plastic tube formed from cellulose acetate propionate. Tube 12 is preferably provided with end caps 14 at each end thereof. End caps 14 are formed of a flexible plastic or rubber material, preferably vinyl, and fit snugly and sealingly onto the ends 16 of tube 12 to seal humidification carrier foam and humidification solution as described hereafter, to prevent loss of moisture prior to use of the cigar humidification apparatus 10. The end caps 14 are removable from tube 12. The tube 12 and end caps 14 are preferably sized to be about the same size as a cigar, so that the apparatus 10 may be placed with cigars in a humidor without additional space or size requirements.

Contained within tube 12 is a porous material 18, which is a material having an ability to receive and keep a humidification solution. Porous material 18 may be any suitable solution carrier material, and may include clay materials, polymer foams, fiber mats and other materials, such as hydrophilic materials, capable of holding the humidification solution in suspension in tube 12. Most preferably, the porous material 18 is florist's foam. Porous material 18 may be held in place in tube 12 by clips 20 which fit into each end of tube 12. Clips 20 are preferably formed from a flexible materials such as a plastic and have a curved portion 22 that has a radius larger than the radius of tube 12, so that the clips 20 expand to frictionally engage the inner walls of tube 12 when located insides the tube 12.

The porous material 18 is soaked with a humidification solution. The humidification solution consists of a mixture of water, saturated salt solution, and propylene glycol. It has been found that the following mixtures, within a range of ±2% for each component, provide a relative humidity of about 72%.

| Propylene Glycol (Vol. %) | Water (Vol. %) | Saturated Salt Solution (Vol. %) |
|---|---|---|
| 1% | 24% | 75% |
| 2% | 28% | 70% |
| 5% | 15% | 80% |
| 10% | 10% | 80% |

Thus, a humidification solution consisting of 1–10% (by volume) propylene glycol, 10–24% (by volume ) water, and 70–80% (by volume) saturated salt solution is effective as a humidification solution in the invention. As noted above, variations of each component may be in the range of ±2% and are equivalent to the ranges defined above. The saturated salt solution is a solution of sodium chloride in water.

The humidification apparatus 10 is placed into use by removing the end caps 14, and placing the apparatus 10 in a closed container 24 with cigars to be preserved, as shown for example in FIG. 4. The humidification solution will generate a relative humidity in the closed container in the range of 72% relative humidity. The apparatus 10 will provide humidity in the desired range in a closed plastic container for about 30 days, and is then disposed of and replaced with a fresh such apparatus 10.

It is to be appreciated that the foregoing is illustrative and not limiting of the invention, and that various changes and modifications to the preferred embodiments described above will be apparent to those skilled in the art. Such changes and modifications can be made without departing from the spirit and scope of the present invention, and it is therefore intended that such changes and modifications be covered by the following claims.

What is claimed is:

1. A cigar humidification apparatus, comprising:

a sealed container having at least one removable cap;

a porous material contained in said sealed container;

a humidification solution provided in said porous material, said humidification solution consisting of 1–10% propylene glycol 10–24% water 70–80% saturated salt solution.

2. A cigar humidification apparatus in accordance with claim 1, wherein said apparatus is disposable.

3. A cigar humidification apparatus in accordance with claim 1, wherein said porous material comprises florists foam.

4. A cigar humidification apparatus in accordance with claim 1, wherein said salt solution comprises a solution of sodium chloride in water.

5. A cigar humidification apparatus in accordance with claim 1, wherein said humidification solution consists of 5% propylene glycol 15% water 80% saturated salt solution.

6. A cigar humidification apparatus in accordance with claim 1, wherein said humidification solution consists of 1% propylene glycol 24% water 75% saturated salt solution.

7. A cigar humidification apparatus in accordance with claim 1, wherein said humidification solution comprises 2% propylene glycol 28% water 70% saturated salt solution.

8. A cigar humidification apparatus in accordance with claim 1, wherein said humidification solution consists of 10% propylene glycol 10% water 80% saturated salt solution.

9. A cigar humidification apparatus, comprising:

a sealed hollow cylindrical container having at least one removable cap;

a porous material contained in said sealed container;

a humidification solution provided in said porous material, said humidification solution consisting of 1–10% propylene glycol 10–24% water 70–80% saturated salt solution.

10. A cigar humidification apparatus in accordance with claim 9, wherein said salt solution comprises a solution of sodium chloride in water.

11. A cigar humidification apparatus in accordance with claim 10, wherein said apparatus is disposable.

12. A cigar humidification apparatus in accordance with claim 10, wherein said porous material comprises florists foam.

13. A cigar humidification apparatus in accordance with claim 10, wherein said humidification solution consists of 5% propylene glycol 15% water 80% saturated salt solution.

14. A cigar humidification apparatus in accordance with claim 10, wherein said humidification solution consists of 1% propylene glycol 24% water 75% saturated salt solution.

15. A cigar humidification apparatus in accordance with claim 10, wherein said humidification solution consists of 2% propylene glycol 28% water 70% saturated salt solution.

16. A cigar humidification apparatus in accordance with claim 10, wherein said humidification solution consists of 10% propylene glycol 10% water 80% saturated salt solution.

* * * * *